US005247886A

United States Patent [19]

Worsey

[11] Patent Number: 5,247,886

[45] Date of Patent: Sep. 28, 1993

[54] BLAST PLUG AND STEMMING CONSTRUCTION FOR BLAST HOLES

[75] Inventor: Paul N. Worsey, Rolla, Mo.

[73] Assignee: The Curators of the University of Missouri, Columbia, Mo.

[21] Appl. No.: 961,130

[22] Filed: Oct. 14, 1992

[51] Int. Cl.[5] ..... F42B 3/00; F42D 3/00

[52] U.S. Cl. ..... 102/312; 102/333

[58] Field of Search ..... 102/312, 313, 333

[56] References Cited

U.S. PATENT DOCUMENTS

| | | | |
|---|---|---|---|
| 85,888 | 1/1869 | Ball | 102/333 |
| 155,731 | 10/1874 | Kalmbach | 102/30 |
| 1,131,876 | 10/1913 | Tietig | 102/30 |
| 1,841,874 | 1/1932 | Borchgrevink | 102/313 |
| 2,300,813 | 11/1942 | Savage | 102/333 X |
| 2,403,386 | 7/1946 | Lubelsky et al. | 102/30 |
| 2,646,845 | 7/1953 | Schillinger | 102/333 X |
| 2,703,528 | 3/1955 | Lee et al. | 102/312 X |
| 2,876,700 | 3/1959 | Householder | 102/333 |
| 2,995,087 | 8/1961 | Edney et al. | 102/30 |
| 3,151,556 | 10/1964 | Karpovich | 102/333 |
| 3,173,368 | 3/1965 | Griffith et al. | 102/333 X |
| 3,264,992 | 8/1966 | Beck | 102/333 X |
| 3,366,056 | 1/1968 | Thunell et al. | 102/333 |
| 3,608,491 | 9/1971 | Botes | 102/333 |
| 3,954,058 | 5/1976 | Sanders et al. | 102/30 |
| 4,449,754 | 5/1984 | Orlov et al. | 102/333 X |
| 4,470,352 | 9/1984 | Leperre | 102/333 X |
| 4,572,075 | 2/1986 | Day et al. | 102/333 X |
| 4,669,540 | 6/1987 | Luoma et al. | 102/333 X |
| 4,754,705 | 7/1988 | Worsey | 102/333 |
| 5,105,743 | 4/1992 | Tano et al. | 102/313 |

FOREIGN PATENT DOCUMENTS

| | | | |
|---|---|---|---|
| 1168059 | 12/1958 | France | 102/333 |

*Primary Examiner*—Peter A. Nelson

*Attorney, Agent, or Firm*—Senniger, Powers, Leavitt & Roedel

[57] ABSTRACT

A plug for use in stemming a blast hole having an explosive charge therein. The plug comprises a wedge member and a stabilizing structure on the wedge member. The wedge member tapers in an outward direction from a relatively wide base to a relatively narrow end and has a central axis extending endwise with respect to the wedge member. The stabilizing structure extends generally axially with respect to the wedge member from adjacent the base of the wedge member. The plug is to be positioned in the blast hole with the base of the wedge member facing inwardly toward the explosive charge, with the narrow end of the wedge member facing outwardly toward the mouth of the blast hole, with the central axis of the wedge member generally coincident with the central longitudinal axis of the blast hole, and with the stabilizing structure in close proximity to the side walls of the blast hole. The stabilizing structure is engageable with the side walls of the blast hole for resisting forces tending to tilt the wedge member away from a position in which the central axis of the wedge member is generally coincident with the central longitudinal axis of the blast hole.

30 Claims, 3 Drawing Sheets

BLAST PLUG AND STEMMING CONSTRUCTION FOR BLAST HOLES

BACKGROUND OF THE INVENTION

This invention relates to a blast plug and stemming construction for explosive loaded blast holes.

Blasting is used in construction and mining to fragment solid rock so that it can be removed. A number of blast holes are drilled and filled with explosive charges which are detonated to produce shock waves that rupture the surrounding rock. There are a number of parameters that govern the effectiveness of a blast, including geologic structure, the size and spacing of the blast holes, the burden (distance to the free face), the type, amount, and placement of explosive, the sequence of detonation, and the stemming technique used.

Stemming is the plugging of the blast hole to prevent the escape of blast gasses. This is important because the blast gasses perform the primary work of the blast. If the blast gasses escape, the effectiveness of the blast is diminished, wasting explosive and requiring additional blasting which entails additional risk and increased drilling, labor, and material costs. Stemming is also important because escaping gasses create an overpressure or air concussion causing objectionable noise and possibly causing personal injury or property damage.

U.S. Pat. No. 4,754,705 to Worsey, incorporated herein by reference, describes a steaming construction having a tapering wedge-shaped blast plug. The plug is positioned in the blast hole outwardly of an explosive charge with its narrower end facing outwardly toward the mouth of the blast hole. Upon detonation of the explosive charge, the plug is driven outward into stemming material in the blast hole to wedge the stemming material laterally against the walls of the blast hole. A stabilizing rod extends endwise from the narrow end of the plug and resists forces tending to tilt the plug relative to the blast hole. Optionally, the rod may be provided with discs to help center the rod and the plug in the blast hole.

Increasing the length of the aforementioned stabilizing rod increases the stability of the plug, i.e., decreases the tendency of the plug to tilt relative to the blast hole. Generally, good stability requires a long rod. However, the longer the rod, the more expensive it is to manufacture and ship.

Often, the rod is used to orient the plug in the blast hole but removed when the plug is in position. Since, in this case, the rod is not fixed to the plug, the plug may come loose from the rod during insertion and may not be properly oriented (e.g., the plug may be tilted relative to the blast hole). Even if the plug is properly inserted, without a stabilizing device it may tilt due to slumping of powder and stemming material in the hole. Improper orientation of the plug within the blast hole reduces the effectiveness of the stemming.

SUMMARY OF THE INVENTION

Among the objects of the present invention may be noted the provision of an improved blast plug; the provision of a blast plug having a stabilizing structure capable of stabilizing the plug during insertion in a blast hole; the provision of such a plug having a stabilizing structure which is relatively compact so that the plug may be conveniently packaged and stored; the provision of such a blast plug which is easy to insert in a blast hole at the proper orientation; and the provision of such a blast plug that is inexpensive to manufacture.

The blast plug of this invention is adapted for use in stemming a blast hole having an explosive charge therein. The blast hole has side walls, an outwardly opening mouth and a central axis extending longitudinally of the blast hole. The plug comprises a wedge member and a stabilizing structure on the wedge member. The wedge member tapers in an outward direction from a relatively wide base to a relatively narrow end and has a central axis extending endwise with respect to the wedge member. The stabilizing structure extends generally axially with respect to the wedge member from adjacent the base of the wedge member. The plug is adapted to be positioned in the blast hole with the base of the wedge member facing inwardly toward the explosive charge, with the narrow end of the wedge member facing outwardly toward the mouth of the blast hole, with the central axis of the wedge member generally coincident with the central longitudinal axis of the blast hole, and with the stabilizing structure in close proximity to the side walls of the blast hole. The stabilizing structure is engageable with the side walls of the blast hole for resisting forces tending to tilt the wedge member away from a position in which the central axis of the wedge member is generally coincident with the central longitudinal axis of the blast hole. Upon detonation of the explosive charge the wedge member is adapted to be driven outwardly into stemming material in the blast hole to force the stemming material laterally outwardly toward the side walls of the blast hole.

Another aspect of the present invention involves a stemming construction employing the blast plug.

These and other advantages and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
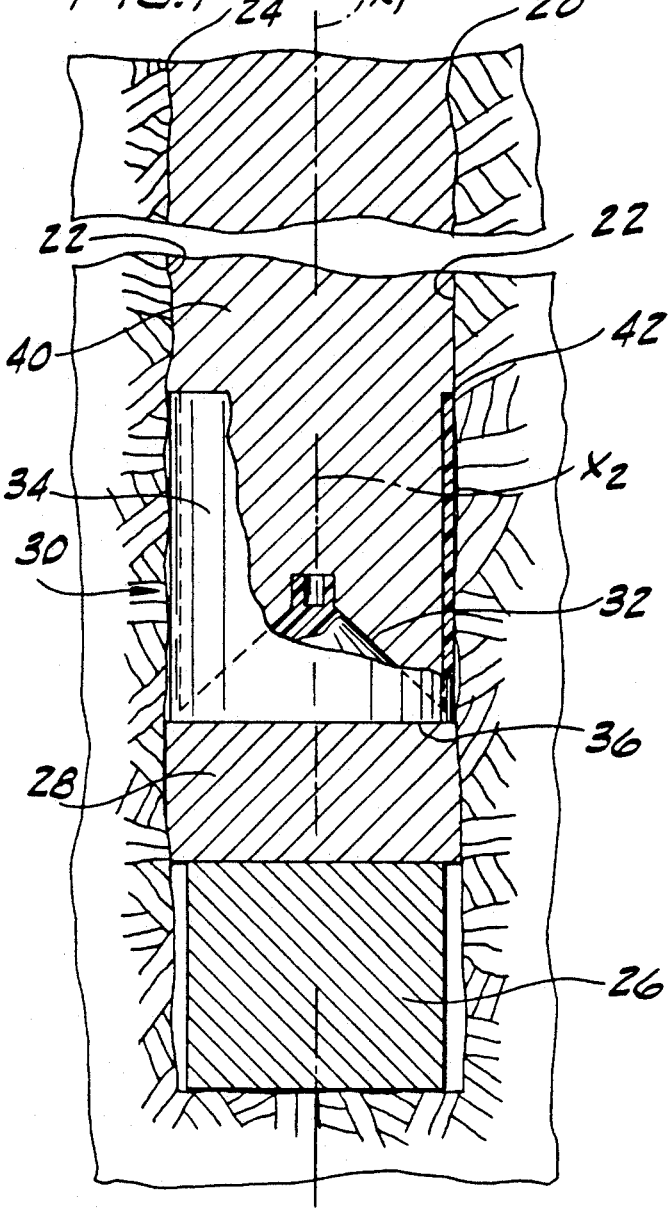
FIG. 1 is a side elevational view of a blast plug of the present invention as it would be installed in a blast hole.

A stemming construction according to the principles of this invention is shown in FIG. 1 as it would be installed in a blast hole 20 having side walls 22, an outwardly opening mouth 24 and a central axis $X_1$ extending longitudinally of the blast hole 20. An explosive charge 26, such as ammonium nitrate or any other suitable blasting agent, is within the blast hole 20 (typically generally adjacent the bottom of the hole 20). The explosive charge 26 is shown for schematic purposes only and may vary in size or shape. In addition, various detonators (not shown) may be provided as necessary.

The stemming construction comprises a plug, designated generally at 30, positioned in the blast hole 20 outwardly of the explosive charge 26. Preferably, a slug 28 of particulate stemming material is interposed between the plug 30 and the explosive charge 26 to shield the plug 30 from the blast forces. The plug 30 comprises a wedge member 32 and a stabilizing structure 34 on the wedge member 32. The wedge member 32 tapers in an outward direction from a relatively wide base 36 to a relatively narrow end 38 and has a central axis $X_2$ extending endwise with respect to the wedge member 32. The stabilizing structure 34 extends generally axially with respect to the wedge member 32 from adjacent the base 36 of the wedge member 32 toward the mouth 24 of the blast hole 20. As shown in FIG. 1, the plug 30 is adapted to be positioned in the blast hole 20 with the base 36 of the wedge member 32 facing inwardly toward the explosive charge 26, with the narrow end 38 of the wedge member 32 facing outwardly toward the mouth 24 of the blast hole 20, with the central axis $X_2$ of the wedge member 32 generally coincident with the central longitudinal axis $X_1$ of the blast hole 20, and with the stabilizing structure 34 in close proximity to the side walls 22 of the blast hole 20. The stabilizing structure 34 is engageable with the side walls 22 of the blast hole 20 for resisting forces tending to tilt the wedge member 32 away from a position in which the central axis $X_2$ of the wedge member is generally coincident with the central longitudinal axis $X_1$ of the blast hole. Particulate stemming material 40 is disposed outwardly of the wedge member 32. Thus, detonation of the explosive charge 26 in blast hole 20 drives the wedge member 32 outwardly into the stemming material 40 to force the stemming material 40 laterally outwardly toward the side walls 22 of the blast hole 20.

Figure 3:
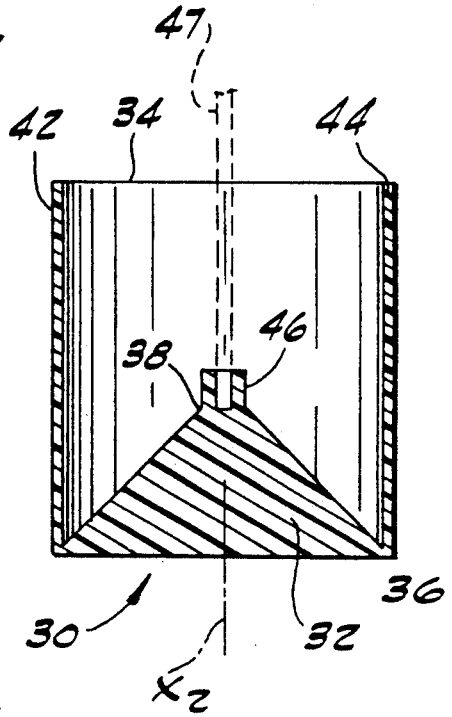
FIG. 3 is a section on line 3—3 of FIG. 2.
Figure 2:
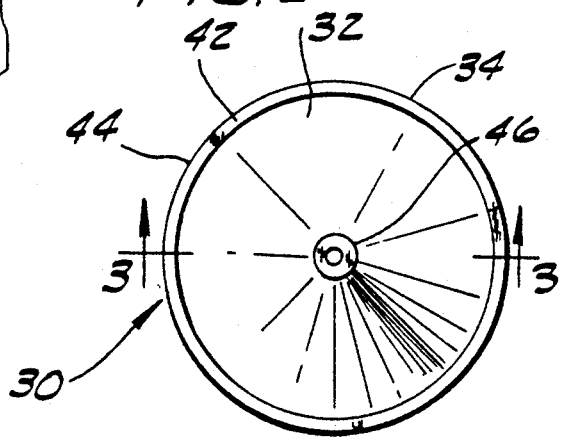
FIG. 2 is a top plan view of the blast plug shown in FIG. 1.

As shown in FIGS. 1-3, the stabilizing structure 34 comprises a cylindrical sleeve 42 extending from adjacent the base 36 of the wedge member 32 generally axially outwardly toward the mouth 24 of the blast hole 20. As shown, the sleeve 42 is integrally formed (e.g., molded) as one piece with the wedge member 32. With the plug 30 positioned in the blast hole 20, the stemming material 40 fills the sleeve 42. Preferably, the diameter of the sleeve 42 is only slightly smaller than the diameter of the blast hole 20 to keep the plug 30 properly oriented during insertion of the plug into the blast hole 20. Also, the length of the sleeve 42 is preferably at least equal to the diameter of the blast hole 20 to prevent tilting of the plug 30 during insertion of the plug 30 into the blast hole 20. The sleeve 42 has a thin wall 44 which is sufficiently flexible or yieldable in a generally radial direction that it expands generally radially outwardly upon detonation of the explosive charge 26. This expansion is caused by the laterally outward movement of the stemming material 40 as the wedge member 32 is driven toward the mouth 24 of the blast hole 20. As the stemming material 40 inside the sleeve 42 is forced laterally outwardly against the wall 44 of the sleeve 42, the wall 44 expands radially outwardly into pressure engagement with the side walls 22 of the blast hole 20. The sleeve 42 should be sufficiently yieldable that it provides no significant resistance to the lateral flow and compaction of the stemming material 40 away from the axis $X_1$ of the blast hole 20, thereby ensuring the necessary pressure engagement between the sleeve 42 and the walls 22 of the blast hole 20, but the sleeve 42 should also be sufficiently rigid to resist tilting of the wedge member 32 relative to the hole 20. The plug 30 may be made from a heat and impact-resistant polymer, such as polystyrene.

The wedge member 32 is preferably conical in shape, although some other shape such as frustoconical, pyramidal, or frustopyramidal can be used. Preferably, the narrow end 38 of the wedge member 32 has a protrusion 46 extending outwardly therefrom. The protrusion 46 is adapted to engage a tool or rod 47 (shown in phantom in FIG. 3) used to insert the plug 30 in the blast hole but removed from the blast hole after the plug 30 is inserted. The wedge member 32 may be provided with an axial aperture (not shown) or a peripheral notch (not shown) for the passage of detonation wires to the explosive charge 26.

With the stemming construction properly installed in the blast hole 20, detonation of the explosive charge 26 creates blast gasses that drive the plug 30 outwardly (up as viewed in FIG. 1). The plug 30 may travel outwardly as much as three times the diameter of the hole 20. The outward movement of the wedge member 32 compacts the stemming material 40 causing the particles to "bridge" and forces the stemming material 40 laterally against the sleeve 42 to expand the sleeve 42 into pressure engagement with the side walls 22 of the blast hole 20 and thereby lock the sleeve 42 to the side walls 22. With the plug 30 locked to the side walls 22 of the blast hole 20, the blast gases act against the surrounding rock causing a more complete fragmentation of the rock and therefore more efficient and effective blasting. Also, during the outward movement of the plug 30, the outer edge of the expanded sleeve 42 engages any laterally inwardly jutting blast hole irregularities to further lock the plug 30 in the blast hole 20.

Figure 4:
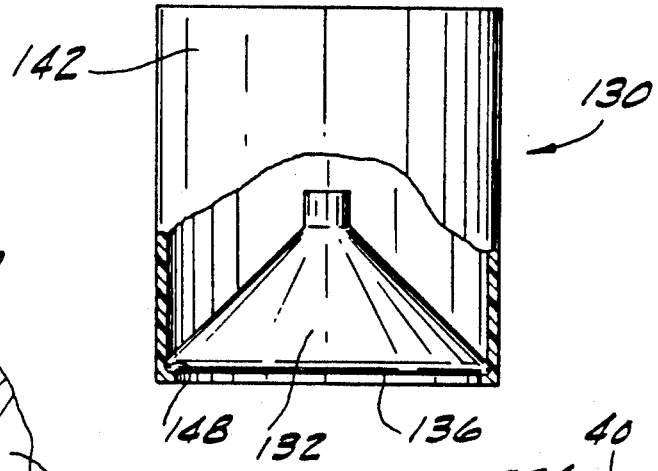
FIG. 4 is a side elevational view of an alternative embodiment of a blast plug of this invention with portions broken away to show that the stabilizing structure is formed as a piece separate from the wedge member.
Figure 4A:
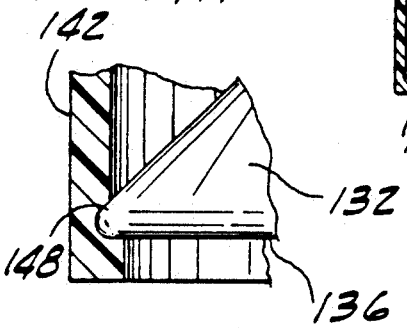
FIG. 4A is an enlarged partial side elevation of the blast plug of FIG. 4 showing the connection of the wedge member to the stabilizing structure.

FIGS. 4 and 4A show an alternative preferred embodiment of a blast plug, designated generally at 130, constructed according to the principles of this invention. The plug 130 has a wedge member 132 and a sleeve 142 and is similar to the blast plug 30 of FIGS. 1-3 except the sleeve 142 is formed as a piece separate from the wedge member 132. For convenience, corresponding parts are numbered the same as those parts shown in FIGS. 1-3 except the prefix "1" has been added to the reference numbers. The sleeve 142 has an internal annular groove 148 adjacent its lower edge for receiving the periphery of the base 136 of the wedge member 132, the arrangement being such that the wedge member 132 snap fits into the groove 148 prior to insertion of the plug 130 in the blast hole. Forming the sleeve 142 separate from the wedge member 132 may be desirable to reduce the cost of manufacturing a plug. The sleeve 142 may be provided with axial slits (not shown) adjacent the groove 148 to provide greater sleeve flexibility and thus facilitate insertion of the wedge member 132 in the sleeve 142. Also, the wedge member 132 may be bonded to the sleeve 142 with a suitable adhesive to resist separation of the wedge member 132 from the sleeve 142 upon detonation of the explosive charge. Preferably, the wedge member 132 is made of an impact-resistant material. However, it is contemplated that the sleeve 142 may be formed of a fragile material, such as cardboard, which will resist tilting of the wedge member 132 during insertion of the plug 130 into the blast hole and will resist tilting of the wedge member 132 prior to detonation of the explosive charge, but will not substantially resist blasting forces tending to tilt the wedge member 132.

FIGS. 5–8 show another alternative preferred embodiment of a blast plug, designated generally at 230, constructed according to the principles of this invention. Plug 230 includes a wedge member 232 and a stabilizing structure 234 and is similar to the blast plug 130 of FIGS. 4 and 4A except the stabilizing structure 234 comprises an annular rim 250 and a plurality of stabilizing segments 252 extending from the rim 250 and spaced laterally from the central axis $X_3$ of the wedge member 232. For convenience, corresponding parts are numbered the same as those parts shown in FIGS. 1–3 except the prefix "2" has been added to the reference numbers.

Figure 5:
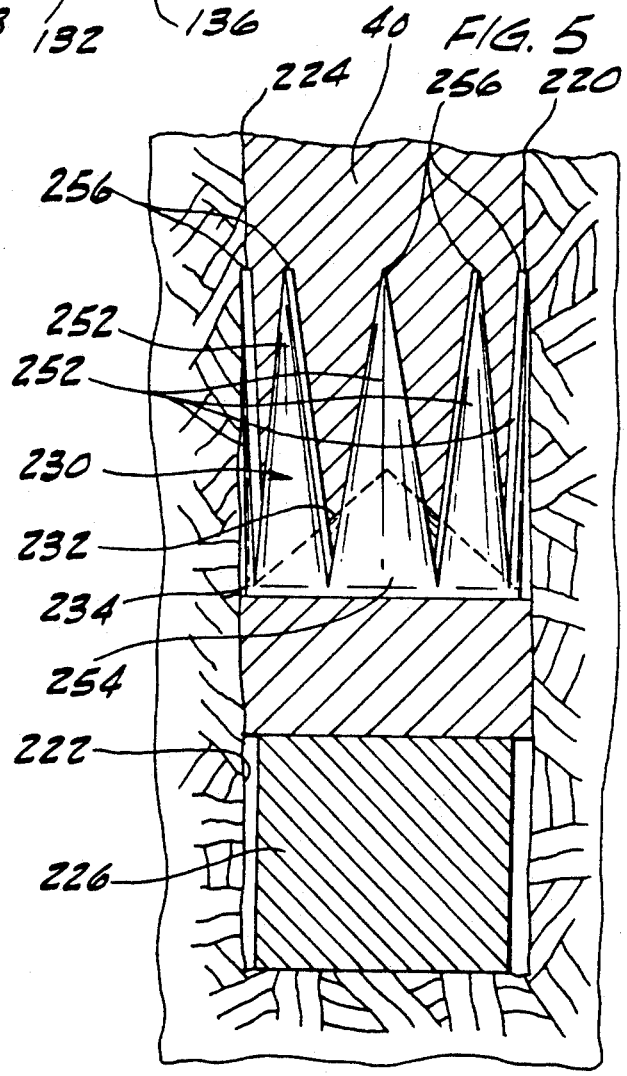
FIG. 5 is a view similar to FIG. 1 showing an alternative embodiment of a blast plug similar to the blast plug of FIG. 4 except the stabilizing structure includes a plurality of stabilizing segments spaced around the wedge member.
Figure 6:
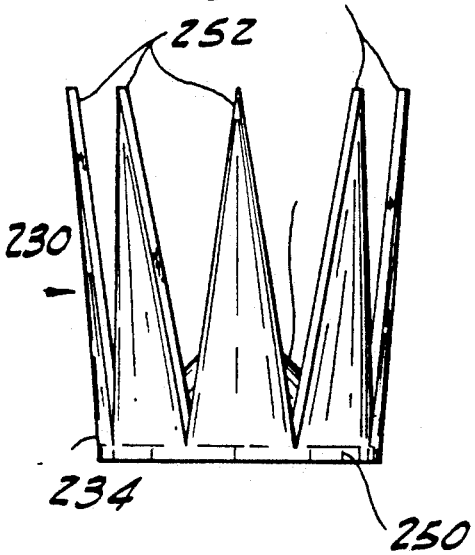
FIG. 6 is a side elevational view of the blast plug of FIG. 5, the plug being shown removed from the blast hole.
Figure 7:
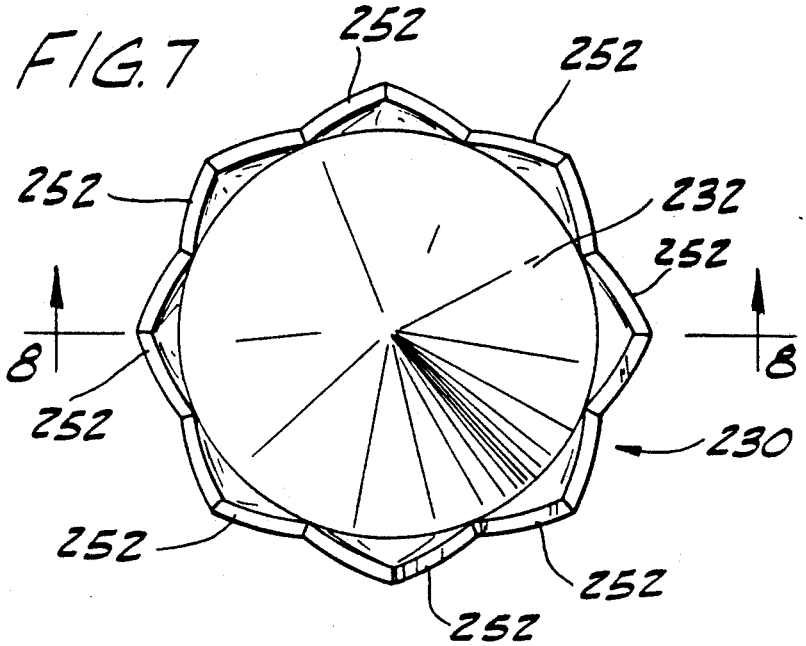
FIG. 7 is a top plan view of the blast plug of FIG. 6.
Figure 8:
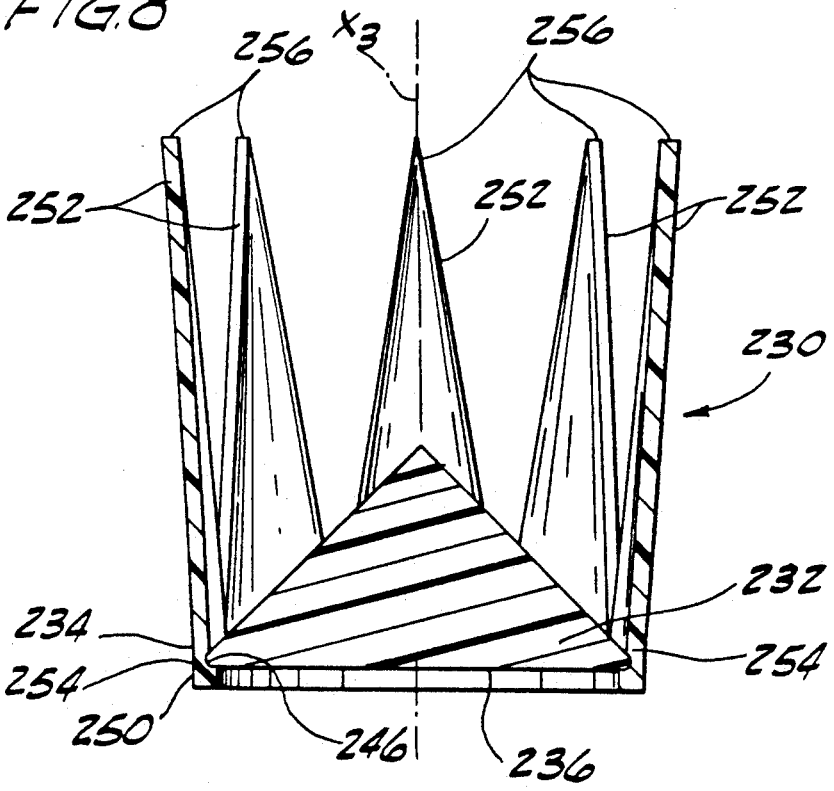
FIG. 8 is a section on line 8—8 of FIG. 7.

The stabilizing segments 252 are spaced at intervals around the wedge member 232. As shown in FIG. 5, each stabilizing segment 252 has an inner end 254 secured to the rim 250 and an outer end 256 projecting outwardly toward the mouth 224 of the blast hole 220. The segments 252 are resiliently biased laterally outwardly toward a position in which the outer ends 256 are disposed laterally (radially) outwardly with respect to the rim 250 (see FIG. 6). The segments flex resiliently laterally inwardly when the plug 230 is inserted in the blast hole 220 with the outer ends 256 of the segments 252 being engageable with the walls 222 of the hole 220 for exerting a laterally outward force which properly orients the plug 230 within the blast hole 220 and resists outward axial movement of the plug 230 toward the mouth 224 of the blast hole 220. Preferably, the segments 252 are pointed at their outer ends 256 to dig into the side walls 222 of the blast hole 220 to further resist outward axial movement of the plug 230. This configuration is particularly advantageous for use in stemming a downwardly-opening blast hole since the spring-like engagement of the resilient segments 252 with the side walls of the blast hole will resist gravitational forces tending to urge the plug 230 downwardly toward the mouth of the blast hole. Similar to the sleeve 142 shown in FIGS. 4 and 4A, the rim 250 has an internal annular groove 246 for receiving the periphery of the base 236 of the wedge member 232. Alternatively, the wedge member 232 may be integrally formed as one piece with the rim 250.

Upon detonation of the explosive charge 226, the plug 230 is driven outwardly toward the mouth 224 of the blast hole 220. The outward movement of the wedge member 232 forces the stemming material 240 laterally against the stabilizing segments 252 to force the segments 252 against the side walls 222 of the blast hole 220. Also, during the outward movement of the plug 230, the pointed outer ends 256 of the stabilizing segments 252 dig into the side walls 222 of the blast hole 220 to further lock the plug 230 in the blast hole 220.

It is preferred that the stabilizing structure 234 resists forces tending to tilt the wedge member 232 during installation, prior to detonation of the explosive charge 226, and upon detonation. However, the stabilizing structure 234 may provide no substantial stabilizing function upon detonation of the explosive charge 226 and still fall within the scope of the present invention.

Although the stabilizing segments 252 are shown to be generally triangular in shape, it is contemplated that other shapes may be suitable.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A stemming construction for a blast hole having an explosive charge therein, said blast hole having side walls, an outwardly opening mouth and a central axis extending longitudinally of the blast hole, said stemming construction comprising:

a wedge member in the blast hole tapering in an outward direction from a relatively wide base to a relatively narrow end and having a central axis extending endwise with respect to the wedge member, said wedge member being positioned with its base facing inwardly toward the explosive charge, with its narrow end facing outwardly toward the mouth of the blast hole, and with its central axis generally coincident with the central longitudinal axis of the blast hole;

a stabilizing structure on the wedge member extending generally axially with respect to the wedge member from adjacent the base of the wedge member in close proximity to the side walls of the blast hole, said stabilizing structure being engageable with the side walls of the blast hole for resisting forces tending to tilt the wedge member away from a position in which the central axis of the wedge member is generally coincident with the central longitudinal axis of the blast hole; and particulate stemming material in the blast hole disposed outwardly of the wedge member so that upon detonation of the explosive charge the wedge member is adapted to be driven into the stemming material to force the stemming material laterally outwardly toward the side walls of the blast hole.

2. A stemming construction as set forth in claim 1 wherein said stabilizing structure comprises a sleeve extending generally axially with respect to the wedge member.

3. A stemming construction as set forth in claim 2 wherein said sleeve extends from adjacent the base of the wedge member outwardly toward the mouth of the blast hole, said stemming material substantially filling the sleeve.

4. A stemming construction as set forth in claim 3 wherein the diameter of said sleeve is only slightly smaller than the diameter of the blast hole.

5. A stemming construction as set forth in claim 4 wherein said sleeve is sufficiently yieldable in a generally radial direction that upon detonation of the explosive charge causing the wedge member to be driven into the stemming material to force the stemming material laterally against the sleeve, the sleeve is adapted to expand generally radially outwardly into pressure engagement with the side walls of the blast hole.

6. A stemming construction as set forth in claim 1 wherein said stabilizing structure is formed as a piece separate from the wedge member and is adapted to be attached to the wedge member prior to insertion of the wedge member in the blast hole.

7. A stemming construction as set forth in claim 6 wherein said stabilizing structure comprises a sleeve having an internal annular groove receiving therein the periphery of the base of the wedge member.

8. A stemming construction as set forth in claim 1 wherein said stabilizing structure comprises a plurality of stabilizing segments spaced laterally from the central axis of said wedge member, each segment being in close proximity to the side walls of the blast hole.

9. A stemming construction as set forth in claim 8 wherein each stabilizing segment extends from adjacent the base of the wedge member toward the mouth of the blast hole.

10. A stemming construction as set forth in claim 9 wherein the stabilizing segments are spaced at intervals around the wedge member.

11. A stemming construction as set forth in claim 9 wherein each stabilizing segment has an inner end adjacent the periphery of said base and an outer end projecting outwardly toward the mouth of the blast hole, said segments being resiliently biased laterally outwardly for engagement of their outer ends against the side walls of the blast hole.

12. A stemming construction as set forth in claim 11 wherein said segments are pointed at their outer ends to dig into the side walls of the blast hole thereby to resist outward axial movement of said wedge member toward the mouth of the blast hole.

13. A stemming construction as set forth in claim 9 wherein said stabilizing structure further comprises an annular rim, said segments projecting outwardly from the annular rim.

14. A stemming construction as set forth in claim 13 wherein said stabilizing structure is formed as a piece separate from the wedge member and is adapted to be attached to the wedge member prior to insertion of the wedge member in the blast hole, said rim including an internal annular groove receiving therein the periphery of the base of the wedge member.

15. A stemming construction for a blast hole having an explosive charge therein, said blast hole having side walls, an outwardly opening mouth and a central axis extending longitudinally of the blast hole, said stemming construction comprising:

a wedge member in the blast hole tapering in an outward direction from a relatively wide base to a relatively narrow end and having a central axis extending endwise with respect to the wedge member, said wedge member being positioned with its base facing inwardly toward the explosive charge, with its narrow end facing outwardly toward the mouth of the blast hole, and with its central axis generally coincident with the central longitudinal axis of the blast hole;

a stabilizing structure on the wedge member spaced laterally from and surrounding the narrow end of the wedge member in close proximity to the side walls of the blast hole, said stabilizing structure being engageable with the side walls of the blast hole for resisting forces tending to tilt the wedge member away from a position in which the central axis of the wedge member is generally coincident with the central longitudinal axis of the blast hole; and particulate stemming material in the blast hole disposed outwardly of the wedge member so that upon detonation of the explosive charge the wedge member is adapted to be driven into the stemming material to force the stemming material laterally outwardly toward the side walls of the blast hole.

16. A stemming construction as set forth in claim 15 wherein said stabilizing structure extends generally axially with respect to the wedge member.

17. A stemming construction as set forth in claim 16 wherein said stabilizing structure comprises a sleeve, a portion of said stemming material substantially filling the sleeve.

18. A stemming construction as set-forth in claim 17 wherein said sleeve is sufficiently yieldable in a generally radial direction that upon detonation of the explosive charge causing the wedge member to be driven into the stemming material to force the stemming material laterally against the sleeve, the sleeve is adapted to expand generally radially outwardly into pressure engagement with the side walls of the blast hole.

19. A stemming construction as set forth in claim 16 wherein said stabilizing structure comprises a plurality of stabilizing segments spaced laterally form the central axis of said wedge member each segment being in close proximity to the side walls of the blast hole.

20. A plug adapted for use in stemming a blast hole having an explosive charge therein, said blast hole having side walls, an outwardly opening mouth and a central axis extending longitudinally of the blast hole, said plug comprising a wedge member and a stabilizing structure on the wedge member, said wedge member tapering in an outward direction from a relatively wide base to a relatively narrow end and having a central axis extending endwise with respect to the wedge member, said stabilizing structure extending generally axially with respect tot he wedge member from adjacent the base of the wedge member, said plug being adapted to be positioned in said blast hole with the base of the wedge member facing inwardly toward the explosive charge, with the narrow end of the wedge member facing outwardly toward the mouth of the blast hole, with the central axis of the wedge member generally coincident with the central longitudinal axis of the blast hole, and with the stabilizing structure in close proximity to the side walls of the blast hole, said stabilizing structure being engageable with the side walls of the blast hole for resisting forces tending to tilt the wedge member away from a position in which the central axis of the wedge member is generally coincident with the central longitudinal axis of the blast hole, the wedge member being sufficiently impact-resistant that upon detonation of the explosive charge the wedge member is adapted to be driven outwardly into particulate stemming material disposed within the blast hole outwardly of the wedge member to force the stemming material laterally toward the side walls of the blast hole.

21. A plug as set forth in claim 20 wherein said stabilizing structure comprises a sleeve extending generally axially with respect to the wedge member.

22. A plug as set forth in claim 21 wherein said sleeve is formed as a piece separate form the wedge member and is adapted to be attached to the wedge member prior to insertion of the plug in the blast hole, said sleeve including an internal annular groove receiving therein the periphery of the base of the wedge member.

23. A plug as set forth in claim 21 wherein said sleeve is sufficiently yieldable in a generally radial direction that after the plug is inserted in the blast hole and upon detonation of the explosive charge causing the wedge member to be driven into stemming material to force the stemming material laterally against the sleeve, the sleeve is adapted to expand generally radially outwardly into pressure engagement with the side walls of the blast hole.

24. A plug as set forth in claim 20 wherein said stabilizing structure comprises a plurality of stabilizing segments spaced laterally from the central axis of said wedge member.

25. A plug as set forth in claim 24 wherein each stabilizing segment has an inner end adjacent the periphery of said base and an outer end projecting outwardly toward the mouth of the blast hole when the plug is positioned in the blast hole, said segments being resiliently biased laterally outwardly for engagement of their outer ends against the side walls of the blast hole.

26. A plug adapted for use in stemming a blast hole having an explosive charge therein, said blast hole having side walls, an outwardly opening mouth and a central axis extending longitudinally of the blast hole, said plug comprising a generally solid wedge member and a stabilizing structure on the wedge member, said wedge member tapering in an outward direction form a relatively wide base t a relatively narrow end and having a central axis extending endwise with respect to the wedge member, said stabilizing structure being spaced laterally from and surrounding the narrow end of the wedge member, said plug being adapted to be positioned in said blast hole with the base of the wedge member facing inwardly toward the explosive charge, with the narrow end of the wedge member facing outwardly toward the mouth of the blast hole, with the central axis of the wedge member generally coincident with the central longitudinal axis of the blast hole, and with the stabilizing structure in close proximity to the side walls of the blast hole, said stabilizing structure being engageable with the side walls of the blast hole for resisting forces tending to tilt the wedge member away from a position in which the central axis of the wedge member is generally coincident with the central longitudinal axis of the blast hole, the wedge member being sufficiently impact-resistant that upon detonation of the explosive charge the wedge member is adapted to be driven outwardly into particulate stemming material disposed within the blast hole outwardly of the wedge member to force the stemming material laterally toward the side walls of the blast hole.

27. A plug as set forth in claim 26 wherein said stabilizing structure is adapted for surrounding stemming material when said plug is positioned in the blast hole.

28. A plug as set forth in claim 27 wherein said stabilizing structure comprises a sleeve extending generally axially with respect to the wedge member, said sleeve being adapted to be filled with stemming material after the plug is inserted in the blast hole.

29. A plug as set forth in claim 28 wherein said sleeve is sufficiently yieldable in a generally radial direction that after the plug is inserted in the blast hole and upon detonation of the explosive charge causing the wedge member to be driven into the stemming material to force the stemming material laterally against the sleeve, the sleeve is adapted to expand generally radially outwardly into pressure engagement with the side walls of the blast hole.

30. A plug as set forth in claim 27 wherein said stabilizing structure comprises a plurality of separate stabilizing segments spaced laterally from the central axis of said wedge member.

* * * * *

UNITED STATES PATENT AND TRADEMARK OFFICE

CERTIFICATE OF CORRECTION

PATENT NO. : 5,247,886

DATED : September 28, 1993

INVENTOR(S) : Paul N. Worsey

It is certified that error appears in the above-identified patent and that said Letters Patent is hereby corrected as shown below:

Column 8, claim 19, line 26, "laterally form the" should read ---laterally from the---.

Column 8, claim 20, line 39, "respect tot he" should read ---respect to the---.

Column 9, claim 26, lines 27-28, "direction form a relatively" should read ---direction from a relatively---.

Column 9, claim 26, line 28, "base t a" should read ---base to a---.

Signed and Sealed this

Twenty-first Day of June, 1994

*Attest:*

Bruce Lehman

BRUCE LEHMAN

*Attesting Officer*

*Commissioner of Patents and Trademarks*